US009978357B2

(12) United States Patent
Benway et al.

(10) Patent No.: US 9,978,357 B2
(45) Date of Patent: May 22, 2018

(54) HEADPHONES WITH ACTIVE NOISE CANCELLATION ADVERSE EFFECT REDUCTION

(71) Applicant: Plantronics, Inc., Santa Cruz, CA (US)

(72) Inventors: Evan Harris Benway, Santa Cruz, CA (US); Kwangsee Allen Woo, Scotts Valley, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days. days.

(21) Appl. No.: 14/989,695

(22) Filed: Jan. 6, 2016

(65) Prior Publication Data

US 2017/0193979 A1 Jul. 6, 2017

(51) Int. Cl.

| | |
|---|---|
| ***H04R 5/00*** | (2006.01) |
| ***G10K 11/178*** | (2006.01) |
| ***H04R 5/033*** | (2006.01) |
| *H04R 1/08* | (2006.01) |

(52) U.S. Cl.

CPC ..... *G10K 11/1786* (2013.01); *H04R 5/033* (2013.01); *G10K 2210/1081* (2013.01); *H04R 1/08* (2013.01); *H04R 2460/01* (2013.01)

(58) Field of Classification Search

CPC ..... H04R 5/033; H04R 1/08; H04R 2460/01; G10K 11/1786; G10K 2210/1081

See application file for complete search history.

(56) References Cited

U.S. PATENT DOCUMENTS

| | | | | |
|---|---|---|---|---|
| 5,844,996 | A | 12/1998 | Enzmann et al. | |
| 6,014,345 | A | 1/2000 | Schmadeka | |
| 7,248,705 | B1 | 7/2007 | Mishan | |
| 8,019,092 | B2 | 9/2011 | Yuan et al. | |
| 8,306,237 | B2 | 11/2012 | Connor | |
| 8,606,571 | B1 | 12/2013 | Every et al. | |
| 9,185,506 | B1 | 11/2015 | Deng | |
| 2009/0074199 | A1 | 3/2009 | Kierstein et al. | |
| 2012/0283593 | A1 | 11/2012 | Searchfield et al. | |
| 2013/0259250 | A1* | 10/2013 | Nicholson | G10K 11/1782 381/71.6 |
| 2014/0126734 | A1* | 5/2014 | Gauger, Jr. | H04R 3/002 381/71.6 |
| 2014/0363010 | A1 | 12/2014 | Christopher et al. | |
| 2015/0003625 | A1 | 1/2015 | Uhle et al. | |
| 2015/0071453 | A1* | 3/2015 | Po | G10K 11/175 381/71.11 |

(Continued)

OTHER PUBLICATIONS

Unknown, "Noise Masking—Sleeping and Snoring Relief," found at URL <http://www.earplugstore.com/noise-masking.html> on Apr. 7, 2014.

(Continued)

*Primary Examiner* — Muhammad N Edun

(74) *Attorney, Agent, or Firm* — Chuang Intellectual Property Law

(57) ABSTRACT

Methods and apparatuses for headphones are disclosed. In one example, a noise cancelling signal is generated with an active noise cancelling system, and the noise cancelling signal is output at a headphones speaker. An undesirable user effect resulting from the noise cancelling signal output at the headphones speaker is mitigated with a noise cancelling adverse effect counteraction signal output simultaneously with the noise cancelling signal.

15 Claims, 7 Drawing Sheets

(56) References Cited

U.S. PATENT DOCUMENTS

| | | | | |
|---|---|---|---|---|
| 2015/0092951 | A1* | 4/2015 | Ou | H03G 3/20 381/71.6 |
| 2015/0348530 | A1 | 12/2015 | Findlay et al. | |
| 2016/0365082 | A1* | 12/2016 | Poulsen | G10K 11/1786 |

OTHER PUBLICATIONS

International Search Report and Written Opinion of the International Searching Authority, dated Apr. 5, 2017, in International Application No. PCT/US2016/069331, 14 pages.

* cited by examiner

HEADPHONES WITH ACTIVE NOISE CANCELLATION ADVERSE EFFECT REDUCTION

BACKGROUND OF THE INVENTION

Many headphones incorporate active noise cancellation techniques to suppress environmental noise heard by the user. These types of headphones, for example, are often used in air travel to suppress airplane noise or in an office or other work environment to suppress general background noise. Active noise cancelling headphones typically operate by detecting a background noise signal and generating an anti-noise signal which destructively interferes with the background noise signal. Although effective at suppressing noise, users of active noise cancelling headphones often report discomfort when wearing these headphones. As a result, improved methods and apparatuses for active noise cancelling headphones are needed.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
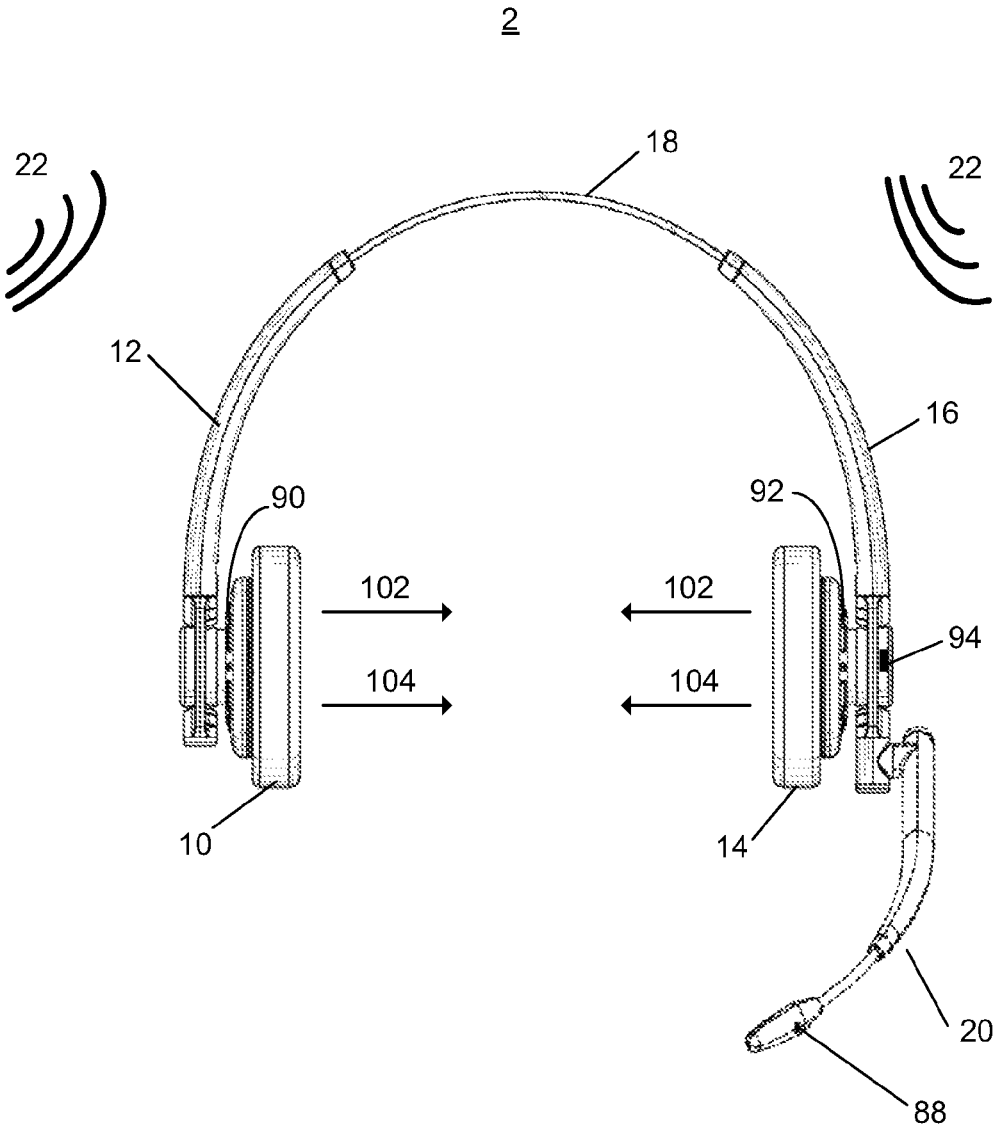
FIG. 1 illustrates headphones with improved active noise cancellation in one example.

Methods and apparatuses for active noise cancelling headphones are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

Block diagrams of example systems are illustrated and described for purposes of explanation. The functionality that is described as being performed by a single system component may be performed by multiple components. Similarly, a single component may be configured to perform functionality that is described as being performed by multiple components. For purpose of clarity, details relating to technical material that is known in the technical fields related to the invention have not been described in detail so as not to unnecessarily obscure the present invention. It is to be understood that various example of the invention, although different, are not necessarily mutually exclusive. Thus, a particular feature, characteristic, or structure described in one example embodiment may be included within other embodiments unless otherwise noted.

A large portion of users of active noise canceling (ANC) headphones (also referred to as active noise reduction headphones) experience an unpleasant "vacuum" or "suction" sensation when the ANC is activated. For a number of users this sensation creates headache and dizziness. It is so unpleasant that many users reject the ANC technology, regardless of its benefits.

In one embodiment, the invention uses a counteraction signal to reduce the "vacuum" or "suction" effect created by active noise cancellation (ANC) headphones. The counteraction signal is played in conjunction with the ANC at a relatively low but constant level. The counteraction signal can also be made to change over time. For example, changes are implemented gradually so as to be imperceptible to the user. Various types of counteraction signals can be used such as pink noise, brown noise, or water sounds. The counteraction signal can also be tailored to the frequencies that are reduced by the noise cancellation, so as to "fill in the gaps" created by the ANC.

Advantageously, the invention makes ANC headphones acceptable to users who otherwise experience discomfort due to the "vacuum" or "suction" sensation. This is especially advantageous in office environments.

In one example, a method for improving user comfort in active noise cancelling headphones includes activating an active noise cancelling system, and generating a noise cancelling signal with the active noise cancelling system. The method further includes outputting the noise cancelling signal at a headphones speaker simultaneously with an ANC adverse effect counteraction signal operable to reduce a user discomfort resulting from the noise cancelling signal.

In one example, a method for improving user comfort in active noise cancelling headphones includes generating a noise cancelling signal with an active noise cancelling system, and outputting the noise cancelling signal at a headphones speaker. The method further includes mitigating an undesirable user effect resulting from the noise cancelling signal output at the headphones speaker with an ANC adverse effect counteraction signal output simultaneously with the noise cancelling signal.

In one example, a headphones apparatus include a user interface, one or more microphones to receive a background sound, a first speaker, and a second speaker. The headphones apparatus further include one or more processors and one or more memories storing one or more application programs executable by the one or more processors. The one or more application programs include instructions to generate a noise cancelling signal from the background sound and output the noise cancelling signal at the first speaker and the second speaker, wherein the one or more application programs further comprise instructions to output an ANC adverse effect counteraction signal configured to reduce a user discomfort resulting from the noise cancelling signal.

FIG. 1 illustrates headphones 2 with improved active noise cancellation in one example. The headphones 2 include a right earpiece 10 includes a right speaker 90, a headband (including a right speaker arm 12, a central support 18 and a left speaker arm 16), a left earpiece 14 includes a left speaker 92, and a microphone boom 20. Headphones 2 include a microphone 94 disposed in proximity to the left earpiece 14 and/or right earpiece 10, the microphone 94 dedicated to detecting background noise for use in an active noise cancellation system at headphones 2. Headphones may also include a second corresponding microphone disposed in proximity to right earpiece 10 dedicated to detecting background noise. In further embodiments, headphones 2 may include more than two microphones. Headphones 2 may also be configured with only a single microphone. In one example, microphone 94 is an omni-directional microphone.

The right earpiece 10 is conventional in nature and fits over a user's right ear. Right earpiece 10 includes a cushion. In a further example, right earpiece 10 may be a cup shaped shell. The right earpiece 10 includes a speaker 90 to convert an audio signal to an audible output. The right earpiece 10 is pivotably coupled to the right speaker arm 12 to provide a comfortable fit against the user's head. The right earpiece 10 is virtually identical to the left earpiece 14.

The right speaker arm 12 is pivotably coupled to the right earpiece 10 at its one end to hold the right earpiece 10 in place on the user's head. The opposite end of the right speaker arm 12 is slidably coupled to one end of the central support 18. The slidable coupling permits the right speaker arm 12 to slide with respect to the central support 18 so that the user can adjust the size of the headphones 2. The central support 18, which adds comfort and support to the headphones 2, is slidably coupled at one end to the right speaker arm 12 and slidably coupled to the left speaker arm 16 on its opposite end. The headband exerts a force in an inward direction so that the left earpiece 14 and right earpiece 10 are pressed against the user ears. In a further example, interaural earphones may be utilized without the use of a headband, whereby a left and right earphone is inserted into the ear canal.

As with the right speaker arm 12, the left speaker arm 16 is slidably coupled at one end to the central support 18 and coupled to the left earpiece 14 and to the microphone boom 20 at its opposite end. As with the right earpiece 10, the left earpiece 14 is pivotably coupled to the left speaker arm 16.

The microphone boom 20 includes a microphone 88 in its tip, such as a noise cancelling microphone. The microphone is used to convert the user's voice to an electrical signal, which is then relayed to an appropriate electronic device. The microphone boom 20 can be adjusted by the user in a number of ways, e.g., its length can be adjusted, it can be moved up and down via the pivotable connection with the left speaker arm 16, and it is rotatable towards and away from the user's mouth. In one example, headphones 2 may utilize microphone 88 to detect background noise 22 which is cancelled by the headphones active noise cancellation system. Background noise 22 may, for example, include airplane noise, wind noise, HVAC system noise, and speech noise.

The microphone boom 20 is pivotable, about an axis generally parallel to a line stretching between the user's ears, from an operative position in which the microphone boom 20 is directed towards the user's mouth, to a stowed position.

When in the stowed position the microphone boom 20 generally conforms to an outer profile of the left speaker arm 16, thereby to give the headphones 2 the appearance of a conventional headphone that does not include a microphone boom when the use of a microphone is not required.

In one example operation, an active noise cancelling system is activated on the headphones 2 to generate a noise cancelling signal 102, which is output at right speaker 90 and left speaker 92. Noise cancelling signal 102 is configured to cancel background noise 22 detected by microphone 94. Noise cancelling signal 102 is output simultaneously with an ANC adverse effect counteraction signal 104 operable to reduce a user discomfort resulting from the noise cancelling signal 102. ANC adverse effect counteraction signal 104 mitigates undesirable user effects resulting from the noise cancelling signal 102 output at the speakers, and is described in further detail below.

Figure 2:
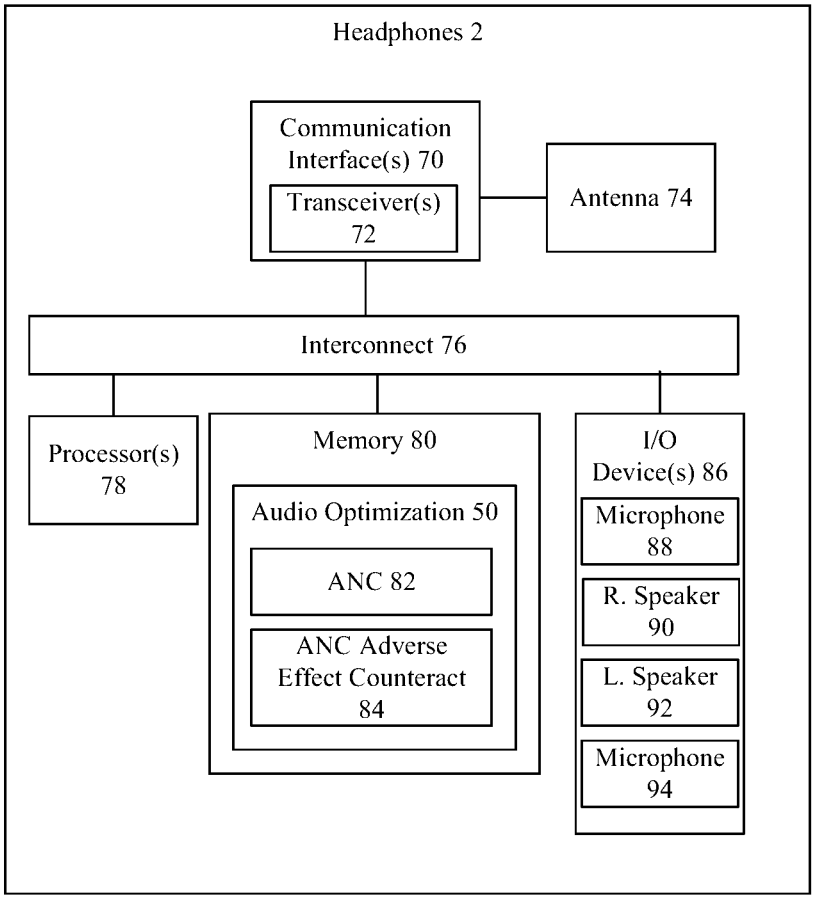
FIG. 2 illustrates a simplified block diagram of the headphones shown in FIG. 1.

FIG. 2 illustrates a simplified block diagram of the headphones 2 shown in FIG. 1. In one example, headphones 2 include a two-way RF communication device having data communication capabilities. The headphones 2 may have the capability to communicate with other computer systems via a local or wide area network.

Headphones 2 include communication interface(s) 70, antenna(s) 74, memory 80, and I/O device(s) 86. Input/output (I/O) device(s) 86 are configured to interface with the user, and include a boom microphone 88 operable to receive a user voice input, microphone 94 to detect background noise, and right speaker 90 and left speaker 92 to output audio. I/O device(s) 86 may also include additional input and output devices.

The headphones 2 include an interconnect 76 to transfer data and a processor 78 is coupled to interconnect 76 to process data. The processor 78 may execute a number of applications that control basic operations, such as data and voice communications via the communication interface(s) 70. The block diagrams shown for headphones 2 do not necessarily show how the different component blocks are physically arranged on headphones 2.

The communications interface(s) 70 may also include other processing means, such as a digital signal processor and local oscillators. Communication interface(s) 70 include one or more transceiver(s) 72. In one example, communications interface(s) 70 include one or more short-range wireless communications subsystems which provide communication between headphones 2 and different systems or devices. For example, transceiver(s) 72 may be a short-range wireless communication subsystem operable to communicate with a mobile device using a personal area network or local area network. The short-range communications subsystem may include one or more of: an infrared device and associated circuit components for short-range communication, a near field communications (NFC) subsystem, a Bluetooth subsystem including a transceiver, or an IEEE 802.11 (WiFi) subsystem in various non-limiting examples.

Processor 78 is configured to execute code stored in a memory 80. Processor 78 executes an audio optimization application 50 including an active noise cancellation application 82 and an ANC adverse effect counteraction application 84 to perform functions described herein. Although shown as separate applications, active noise cancellation application 82 and ANC adverse effect counteraction application 84 may be integrated into a single application. For example, ANC adverse effect counteraction application 84 may be a submodule of active noise cancellation application 82.

Utilizing audio optimization application 50, headphones 2 are operable to generate a noise cancelling signal 102 from a background sound detected at microphone 94 and output the noise cancelling signal 102 at the left speaker 92 and the right speaker 90. Headphones 2 further operate to output an ANC adverse effect counteraction signal 104 configured to reduce a user discomfort resulting from the noise cancelling signal 102.

In one example, ANC adverse effect counteraction application 84 generates the ANC adverse effect counteraction signal 104. In one example, the ANC adverse effect counteraction signal 104 is stored in memory 80 for retrieval and output.

In one example, the ANC adverse effect counteraction signal 104 is output at a low level, for example, 35 dB or less, to minimize audibility to the user. In one example, the ANC adverse effect counteraction signal 104 is output at a level so that it is not discernable by the user. In this example, the ANC adverse effect counteraction signal 104 is not utilized to mask background noise 22 and therefore need not be audible to the user.

In one example, the audio optimization application 50 configures the ANC adverse effect counteraction signal 104 responsive to the noise cancelling signal 102 so that it is optimized to counteract the adverse effects of noise cancelling signal 102. In one embodiment, the frequency profile of ANC adverse effect counteraction signal 104 is adjusted based on noise cancelling signal 102. For example, the profiles may be matched.

By counteracting adverse effects of the active noise cancelling signal 102, ANC adverse effect counteraction signal 104 advantageously allows more aggressive active noise cancellation settings in the active noise cancellation system.

In one example, the ANC adverse effect counteraction signal 104 operable to reduce a user discomfort resulting from the noise cancelling signal 102 is user adjustable (e.g., output level) at a user interface. In one example, the ANC adverse effect counteraction signal 104 is a noise signal. For example, the noise signal may be a random pink, brown, or white noise. The noise signal may be generated or previously recorded and stored in headphones memory. In one example, the ANC adverse effect counteraction signal 104 is a water sound stored in headphones memory.

While only a single processor 78 is shown, headphones 2 may include multiple processors and/or co-processors, or one or more processors having multiple cores. The processor 78 and memory 80 may be provided on a single application-specific integrated circuit, or the processor 78 and the memory 80 may be provided in separate integrated circuits or other circuits configured to provide functionality for executing program instructions and storing program instructions and other data, respectively. Memory 80 also may be used to store temporary variables or other intermediate information during execution of instructions by processor 78. Memory 80 may include both volatile and non-volatile memory such as random access memory (RAM) and read-only memory (ROM). Device event data for headphones 2 may be stored in memory 80.

Interconnect 76 may communicate information between the various components of headphones 2. Instructions may be provided to memory 80 from a storage device, such as a read-only memory, via a remote connection (e.g., over a network via communication interface(s) 70) that may be either wireless or wired providing access to one or more electronically accessible media. In alternative examples, hard-wired circuitry may be used in place of or in combination with software instructions, and execution of sequences of instructions is not limited to any specific combination of hardware circuitry and software instructions.

Headphones 2 may include operating system code and specific applications code, which may be stored in non-volatile memory. For example the code may include drivers for the headphones 2 and code for managing the drivers and a protocol stack for communicating with the communications interface(s) 70.

Figure 3A:
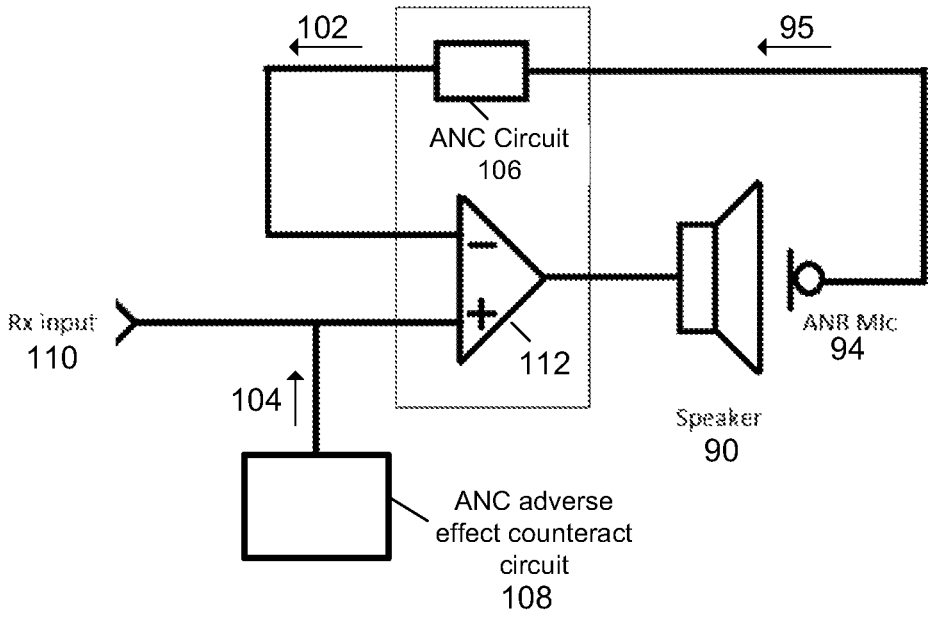
FIGS. 3A-3C are functional diagrams illustrating operation of the headphones shown in FIG. 1 in various examples.

FIG. 3A is a diagram illustrating a logical arrangement of a noise cancellation feedback loop in active noise cancelling headphones. In one example, signal processing operations performed on any audio signals by the blocks depicted are in the discrete time domain. It is also possible to implement some or all of the functional unit blocks in analog form (continuous time domain).

An ANC block 106 (also referred to as ANC circuit 106) generates an anti-noise signal (e.g., noise cancelling signal 102) from a noise signal 95 output from microphone 94. Noise signal 95 may include components from a background noise as well as audio output from right speaker 90.

The noise cancelling signal 102 is combined with a desired audio signal (e.g., Rx input signal 110) and an ANC adverse effect counteraction signal 104 by a mixer 112. ANC adverse effect counteraction signal 104 is generated by an ANC adverse effect counteract block 108. The combined signal is then fed to the input of the right speaker 90 (and/or left speaker 92) for output to the user ear. Additional examples may use either a feedback or feed forward ANC mechanism.

Microphone 94 is located and oriented in such a manner as to detect ambient acoustic noise. Microphone 94 may also detect sound emitted from the right speaker 90. The microphone 94 may be embedded in the housing of headphones 2 in which the right speaker 90 is also integrated, i.e. located close to the right speaker 90 and far from the primary or talker microphone 88 that is used to detect the near-end user's speech.

The arrangement shown in FIG. 3A may be implemented within an audio coder/decoder (i.e., a codec chip) that may perform other audio related functions including analog-to-digital conversion, digital-to-analog conversion, and analog pre-amplification of microphone signals. The arrangement of FIG. 3A may be implemented in a digital signal processing codec suitable for mobile wireless communications. This codec may include functions for speech enhancement processing, including acoustic echo cancellation, noise suppression, automatic gain control, companding, expansion, and equalization. The functionality depicted in FIG. 3A may be performed in discrete-time domain, in which analog signals such as the output of an analog microphone have been converted to digital form, and the output signal of the mixer 112 has been converted to analog form prior to being input to the right speaker 90 (or left speaker 92).

Figure 3B:
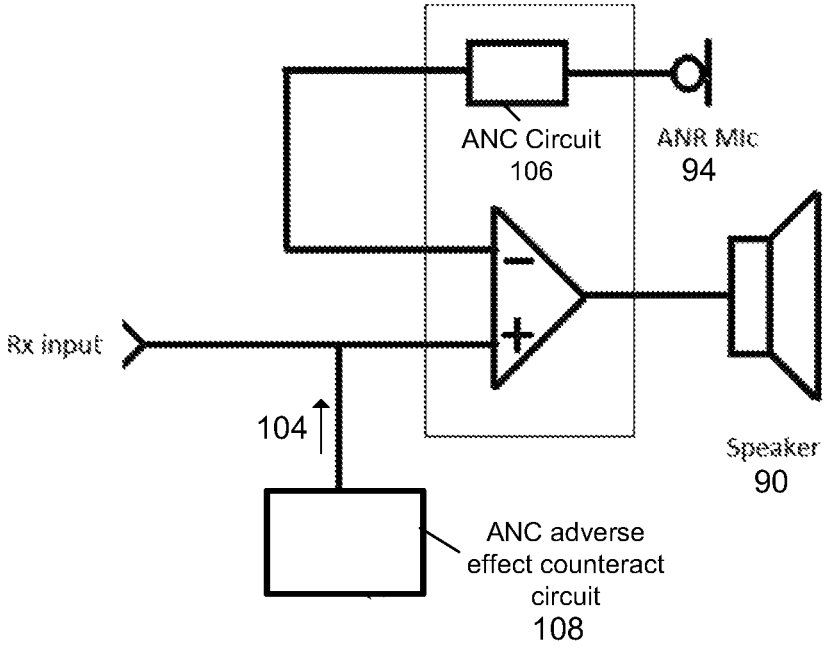
Figure 3C:
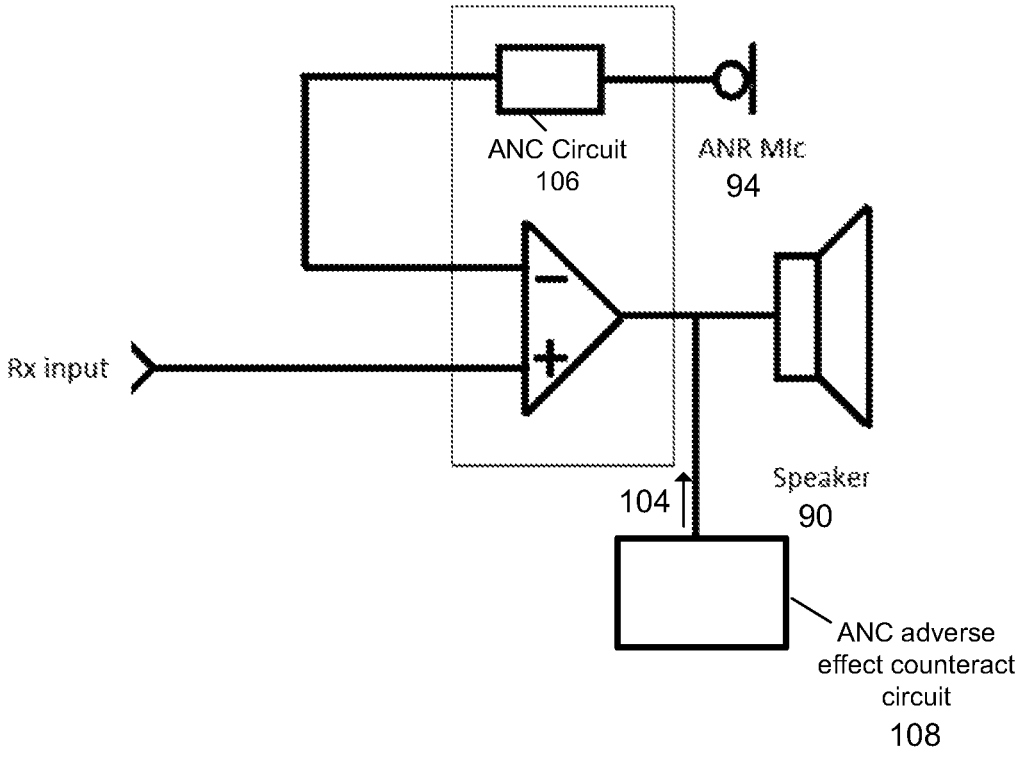

FIGS. 3B and 3C are diagrams illustrating a logical arrangement of a noise cancellation feedback loop in active noise cancelling headphones in further examples. Operation of the circuits shown in FIG. 3B and FIG. 3C is substantially similar to that shown in FIG. 3A, except that a feed forward arrangement is utilized whereby microphone 94 does not detect sound from the right speaker 90. In this feed forward arrangement, ANC block 106 may be arranged to output ANC adverse effect counteraction signal 104 directly to right speaker 94, as shown in FIG. 3C.

Figure 4:
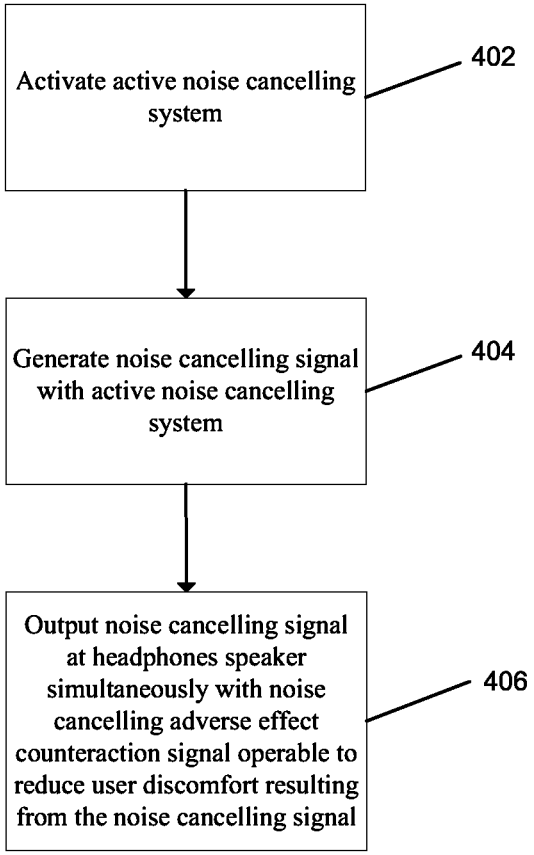
FIG. 4 is a flow diagram illustrating improved active noise cancellation in one example.

FIG. 4 is a flow diagram illustrating active noise cancellation in one example. At block 402, an active noise cancelling system is activated on headphones. At block 404, a noise cancelling signal is generated with the active noise cancelling system.

At block 406, the noise cancelling signal is output at a headphones speaker simultaneously with an ANC adverse effect counteraction signal. The ANC adverse effect counteraction signal is operable to reduce a user discomfort resulting from the noise cancelling signal. In one example, the ANC adverse effect counteraction signal is output at a level of 35 dB or less.

The ANC adverse effect counteraction signal may be output at a level so that it is not discernable by the user and may be configured responsive to the noise cancelling signal. In one example, the ANC adverse effect counteraction signal is a random noise signal. In one example, the ANC adverse effect counteraction signal is a water sound.

Figure 5:
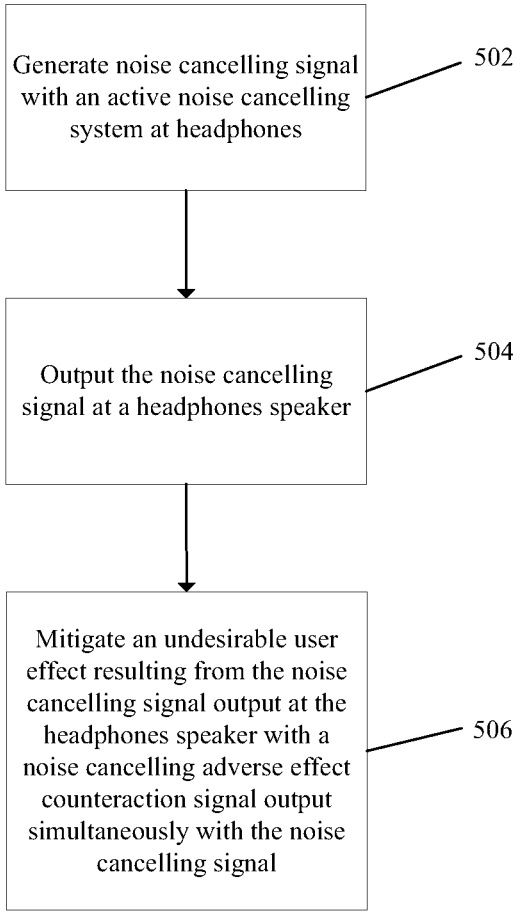
FIG. 5 is a flow diagram illustrating improved active noise cancellation in one example.

FIG. 5 is a flow diagram illustrating active noise cancellation in one example. At block 502, a noise cancelling signal is generated with an active noise cancelling system at headphones. At block 504, the noise cancelling signal is output at a headphones speaker.

At block 506, an undesirable user effect resulting from the noise cancelling signal output at the headphones speaker is mitigated with an ANC adverse effect counteraction signal output simultaneously with the noise cancelling signal. In one example, the ANC adverse effect counteraction signal is output at a level of 35 dB or less. The ANC adverse effect counteraction signal may be output at a level so that it is not discernable by the user.

In one example, the ANC adverse effect counteraction signal is configured responsive to the noise cancelling signal. In one example, the ANC adverse effect counteraction signal is a noise signal or a water sound.

While the exemplary embodiments of the present invention are described and illustrated herein, it will be appreciated that they are merely illustrative and that modifications can be made to these embodiments without departing from the spirit and scope of the invention. Acts described herein may be computer readable and executable instructions that can be implemented by one or more processors and stored on a computer readable memory or articles. The computer readable and executable instructions may include, for example, application programs, program modules, routines and subroutines, a thread of execution, and the like. In some instances, not all acts may be required to be implemented in a methodology described herein. Elements described herein in block diagrams may be implemented as one of, or a combination of analog circuitry, digital circuitry, or one or more microprocessors executing software instructions. The software instructions may include digital signal processing (DSP) instructions.

Terms such as "component", "module", "circuit", "application", and "system" are intended to encompass software, hardware, or a combination of software and hardware. For example, a system or component may be a process, a process executing on a processor, or a processor. Furthermore, a functionality, component or system may be localized on a single device or distributed across several devices. The described subject matter may be implemented as an apparatus, a method, or article of manufacture using standard programming or engineering techniques to produce software, firmware, hardware, or any combination thereof to control one or more computing devices.

Thus, the scope of the invention is intended to be defined only in terms of the following claims as may be amended, with each claim being expressly incorporated into this Description of Specific Embodiments as an embodiment of the invention.

What is claimed is:

1. A method comprising:

activating an active noise cancelling system on headphones;

generating a noise cancelling signal with the active noise cancelling system; and outputting a noise cancelling adverse effect counteraction signal at a level of 35 dB or less comprising a noise signal simultaneously with the noise cancelling signal at a headphones speaker to reduce a user discomfort resulting from the noise cancelling signal.

2. The method of claim 1, wherein the noise cancelling adverse effect counteraction signal is output at a level so that it is not discernable by a user.

3. The method of claim 1, wherein the noise cancelling adverse effect counteraction signal is configured responsive to the noise cancelling signal.

4. The method of claim 1, further comprising receiving a user adjustment of the noise cancelling adverse effect counteraction signal at a headphones user input interface.

5. A method comprising:

generating a noise cancelling signal with an active noise cancelling system at headphones;

outputting the noise cancelling signal at a headphones speaker; and mitigating an undesirable user effect resulting from the noise cancelling signal output at the headphones speaker with a noise cancelling adverse effect counteraction signal output at a level of 35 dB or less simultaneously with the noise cancelling signal.

6. The method of claim 5, wherein the noise cancelling adverse effect counteraction signal is output at a level so that it is not discernable by a user.

7. The method of claim 5, wherein the noise cancelling adverse effect counteraction signal is configured responsive to the noise cancelling signal.

8. The method of claim 5, wherein the noise cancelling adverse effect counteraction signal is a noise signal.

9. The method of claim 5, further comprising receiving a user adjustment of the noise cancelling adverse effect counteraction signal at a headphones user input interface.

10. A headphones apparatus comprising:

one or more microphones to receive a background sound;

a first speaker;

a second speaker;

one or more processors; and one or more memories storing one or more application programs executable by the one or more processors, the one or more application programs comprising instructions to generate a noise cancelling signal from the background sound and output the noise cancelling signal at the first speaker and the second speaker, wherein the one or more application programs further comprise instructions to output a noise cancelling adverse effect counteraction signal configured to reduce a user discomfort resulting from the noise cancelling signal, wherein the noise cancelling adverse effect counteraction signal comprises a noise signal and is output at a level of 35 dB or less.

11. The headphones apparatus of claim 10, wherein the one or the one or more application programs further comprise instructions to generate the noise cancelling adverse effect counteraction signal.

12. The headphones apparatus of claim 10, wherein the noise cancelling adverse effect counteraction signal operable to reduce the user discomfort is stored in the one or more memories.

13. The headphones apparatus of claim 10, wherein the noise cancelling adverse effect counteraction signal is output at a level so that it is not discernable by a user.

14. The headphones apparatus of claim 10, wherein the one or the one or more application programs further comprise instructions to configure the noise cancelling adverse effect counteraction signal responsive to the noise cancelling signal.

15. The headphones apparatus of claim 10, wherein the noise cancelling adverse effect counteraction signal operable to reduce the user discomfort resulting from the noise cancelling signal is user adjustable at a user interface of the headphones apparatus.

* * * * *